US006810960B2

(12) United States Patent
Pia

(10) Patent No.: US 6,810,960 B2
(45) Date of Patent: Nov. 2, 2004

(54) METHODS FOR INCREASING PRODUCTION FROM A WELLBORE

(75) Inventor: Giancarlo T. Pia, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/127,325

(22) Filed: Apr. 22, 2002

(65) Prior Publication Data

US 2003/0196817 A1 Oct. 23, 2003

(51) Int. Cl.[7] ..... E21B 43/00

(52) U.S. Cl. ..... 166/370; 166/312; 166/376; 175/57

(58) Field of Search ..... 166/312, 370, 166/376; 175/57

(56) References Cited

U.S. PATENT DOCUMENTS

| | | | | |
|---|---|---|---|---|
| 3,949,820 A | * | 4/1976 | Furse | 175/286 |
| 4,917,188 A | | 4/1990 | Fitzpatrick, Jr. | |
| 5,253,708 A | | 10/1993 | Alexander | |
| 5,458,192 A | | 10/1995 | Hunt | 166/250 |
| 5,642,787 A | | 7/1997 | Hutchinson | 175/269 |
| 5,853,054 A | * | 12/1998 | McGarian et al. | 175/267 |
| 5,862,870 A | | 1/1999 | Hutchinson | 175/269 |
| 6,065,550 A | | 5/2000 | Gardes | |
| 6,165,947 A | | 12/2000 | Chang et al. | |
| 6,234,258 B1 | * | 5/2001 | Karigan | 175/66 |
| 2003/0029644 A1 | * | 2/2003 | Hoffmaster et al. | 175/263 |

OTHER PUBLICATIONS

PCT International Search Report, International Application No. PCT/US 03/03660, dated Jul. 24, 2003.

* cited by examiner

*Primary Examiner*—David Bagnell
*Assistant Examiner*—Giovanna Collins
(74) *Attorney, Agent, or Firm*—Moser, Patterson & Sheridan, L.L.P.

(57) ABSTRACT

The present invention generally relates to a method for recovering productivity of an existing well. First, an assembly is inserted into a wellbore, the assembly includes a tubular member for transporting drilling fluid downhole and an under-reamer disposed at the end of the tubular member. Upon insertion of the assembly, an annulus is created between the assembly and the wellbore. Next, the assembly is positioned near a zone of interest and drilling fluid is pumped down the tubular member. The drilling fluid is used to create an underbalanced condition where a hydrostatic pressure in the annulus is below a zone of interest pressure. The under-reamer is activated to enlarge the wellbore diameter and remove a layer of skin for a predetermined length. During the under-reaming operation, the hydrostatic pressure is maintained below the zone of interest pressure, thereby allowing wellbore fluid to migrate up the annulus and out of the wellbore. After the under-reaming operation, back-reaming may be performed to remove any excess wellbore material, drill cuttings and fines left over from the under-reaming operation and to ensure no additional skin damage is formed in wellbore. Upon completion, the under-reamer is deactivated and the assembly is removed from the wellbore.

28 Claims, 5 Drawing Sheets

METHODS FOR INCREASING PRODUCTION FROM A WELLBORE

BACKGROUND OF THE INVENTION

1. Field of the Invention

The present invention relates to methods for increasing the productivity of an existing well. More particularly, the invention relates to methods for under-reaming a wellbore. More particularly still, the invention relates to methods for under-reaming a wellbore in an underbalanced condition to reduce wellbore damage.

2. Description of the Related Art

Historically, wells have been drilled with a column of fluid in the wellbore designed to overcome any formation pressure encountered as the wellbore is formed. This "overbalanced condition" restricts the influx of formation fluids such as oil, gas or water into the wellbore. Typically, well control is maintained by using a drilling fluid with a predetermined density to keep the hydrostatic pressure of the drilling fluid higher than the formation pressure. As the wellbore is formed, drill cuttings and small particles or fines are created by the drilling operation. Formation damage may occur when the hydrostatic pressure forces the drilling fluid, drill cuttings and fines into the reservoir. Further, drilling fluid may flow into the formation at a rate where little or no fluid returns to the surface. This flow of fluid into the formation can cause the "fines" to line the walls of the wellbore. Eventually, the cuttings or other solids form a wellbore "" skin along the interface between the wellbore and the formation. The wellbore skin restricts the flow of the formation fluid and thereby damages the well.

The degree which a wellbore is lined with particulate matter is measured by the "skin factor". The skin factor is proportional to the steady state pressure difference around the wellbore. A positive skin factor indicates that the flow of hydrocarbons into a wellbore is restricted, while a negative skin factor indicates enhanced production of hydrocarbons, which is usually the result of stimulation. The skin factor is calculated to determine the production efficiency of a wellbore by comparing actual conditions with theoretical or ideal conditions. Typically, the efficiency of the wellbore relates to a productivity index, a number based upon the amount of hydrocarbons exiting the wellbore.

One method of addressing the damage described above is with some form of hydraulic fracturing treatment. For example, in an "acid frac", hydrochloric acid treatment is used in a carbonate formation to etch open faces of induced fractures. When the treatment is complete, the fracture closes and the etch surfaces provide a high conductivity path from the reservoir to the wellbore. In some situations, small sized particles are mixed with fracturing fluid to hold fractures open after the hydraulic fracturing treatment. This is known in the industry as "prop and frac". In addition to the naturally occurring sand grains, man made or specially engineered proppants, such as resin coated sand or high strength ceramic material, may also be used to form the fracturing mixture used to "prop and frac". Proppant materials are carefully sorted for size and sphericity to provide an effective means to prop open the fractures, thereby allowing fluid from the reservoir to enter the wellbore. However, both the "acid frac" and "prop and frac" are very costly procedures and ineffective in lateral wells. In addition, both methods are unsuccessful in removing long segments of wellbore skin. Additionally, both methods create wellbore material such as fines that may further damage the wellbore by restricting the flow of the reservoir fluid into the wellbore. Finally, both methods are difficult to control with respect to limiting the treatment to a selected region of the wellbore.

There is a need, therefore, for a cost effective method to remove wellbore skin to recover and increase the productivity of an existing well. There is a further need for a method to remove long segments of wellbore skin without causing further damage to the wellbore by restricting the flow of the reservoir fluid into the wellbore. There is yet a further need for a method to remove skin within a selected region of the wellbore. There is even yet a further need for an effective method to remove wellbore skin in lateral wells. Finally, there is a need for a method that will not only remove wellbore skin but also create negative skin, thereby enhancing the production of the well.

SUMMARY OF THE INVENTION

The present invention generally relates to a method for recovering productivity of an existing well. First, an assembly is inserted into a wellbore, the assembly includes a tubular member for transporting drilling fluid downhole and an under-reamer disposed at the end of the tubular member. The under reamer includes blades disposed on a front portion and a rear portion. Upon insertion of the assembly, an annulus is created between the assembly and the wellbore. Next, the assembly is positioned near a zone of interest. Drilling fluid is pumped down the tubular member and exits out ports in the under-reamer. The drilling fluid is used to create an underbalanced condition where a hydrostatic pressure in the annulus is below the formation pressure at a zone of interest. The under-reamer is activated, thereby allowing the blades on the front portion to contact the wellbore diameter. The tubular member urges the activated under-reamer downhole to enlarge the wellbore diameter and remove a layer of skin for a predetermined length. During the under-reaming operation, its underbalance condition allows the wellbore fluid to migrate up the annulus and out of the wellbore. After the under-reamer has removed the skin and a portion of the formation, back-reaming may be performed to remove any excess wellbore material, drill cuttings and fines left over from the under-reaming operation. The underbalanced back-reaming operation ensures no additional skin damage is formed in the wellbore. Upon completion, the under-reamer is deactivated and the assembly is removed from the wellbore.

In another aspect, a separation system is used in conjunction with a data acquisition system to measure the amount of hydrocarbon production. The data acquisition system collects data on the productivity of the specific well and compares the data with a theoretical valve to determine the effectiveness of the under-reaming operation. The data acquisition system may also be used in wells with several zones of interests to determine which zones are most productive and the effectiveness of the skin removal.

BRIEF DESCRIPTION OF THE DRAWINGS

So that the manner in which the above recited features and advantages of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
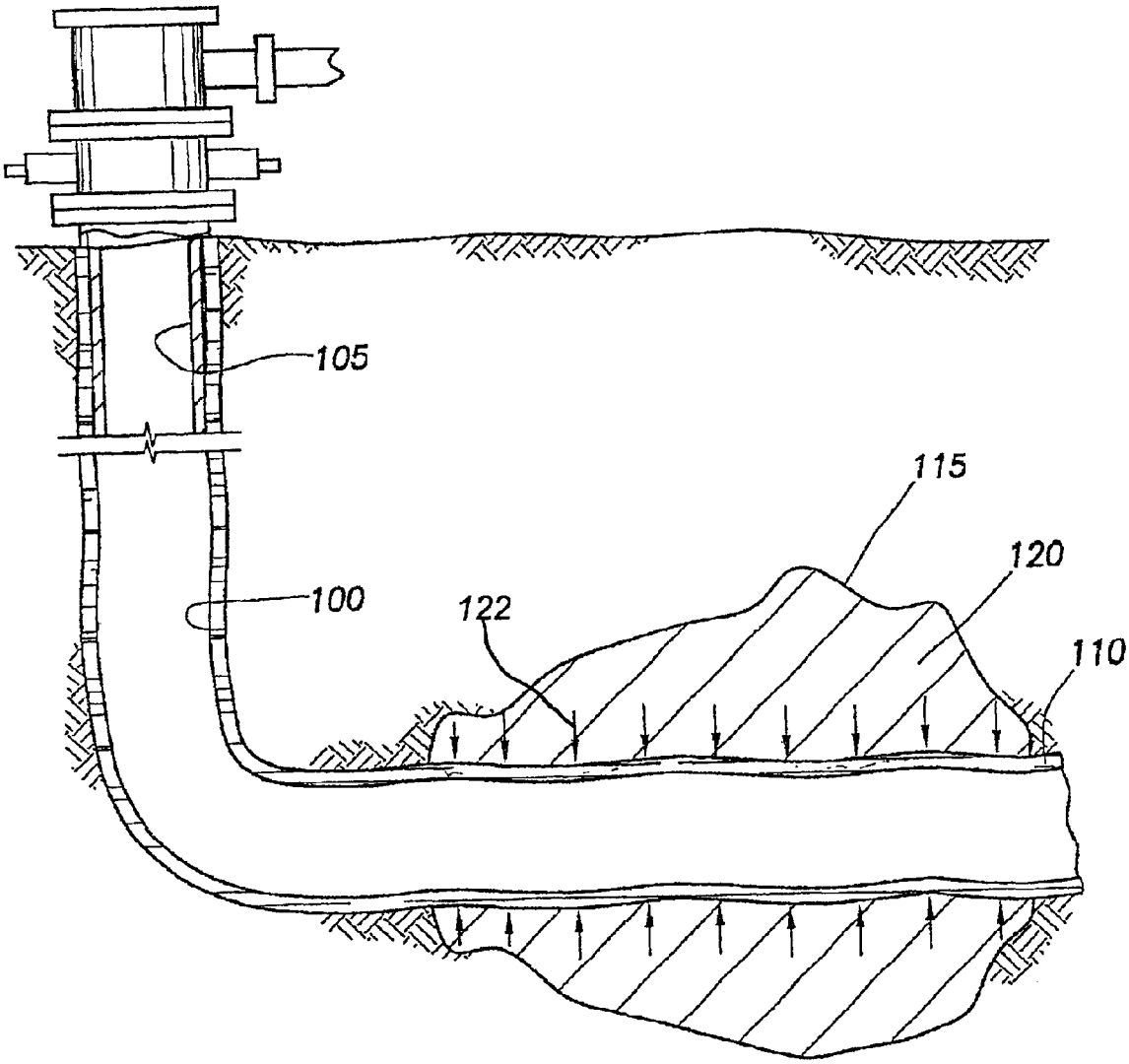
FIG. 1 is a cross-sectional view of a wellbore having a layer of skin damage on the surface thereof.

FIG. 1 is a cross-sectional view of a wellbore 100 having a layer of skin 110 on the surface thereof. As illustrated, a horizontal portion of wellbore 100 is uncased adjacent a formation 115 and is lined with casing 105 at the upper end. The uncased portion is commonly known in the industry as a "barefoot" well. It should be noted that this invention is not limited to use with uncased horizontal wells but can also be used with cased and vertical wellbores. The layer of skin 110 is created throughout the diameter of the wellbore 100 in the initial overbalanced drilling operation of the wellbore 100. The skin 110 clogs the wellbore 100, thereby restricting the flow into the wellbore 100 of formation fluid 120 as illustrated by arrow 122. Because the skin 110 restricts the flow of formation fluid 120, the skin 110 is said to have a positive skin factor.

Figure 2:
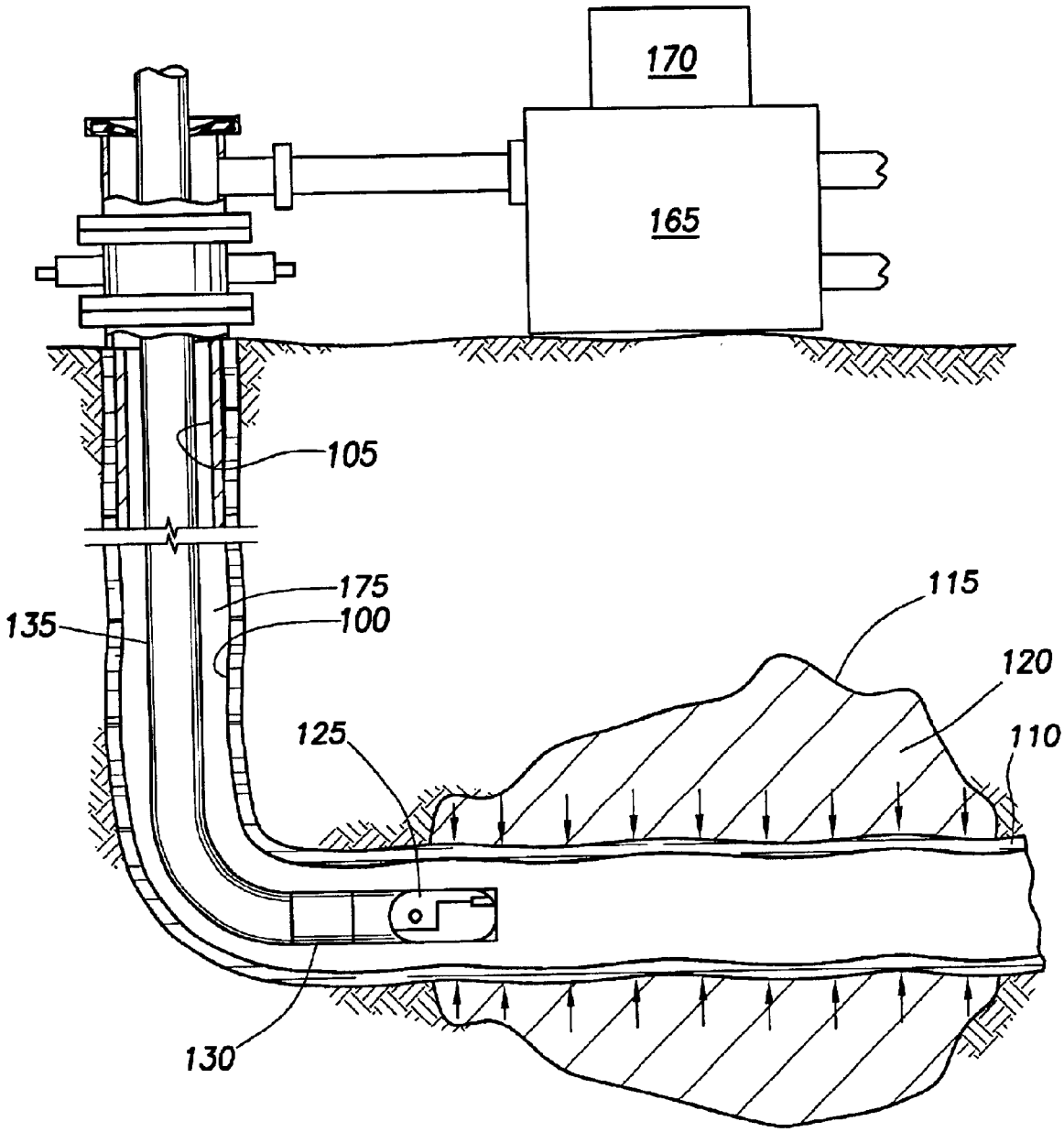
FIG. 2 is a cross-sectional view of a wellbore illustrating the placement of an under-reamer at a predetermined location near a formation adjacent the wellbore.

FIG. 2 is a cross-sectional view of the wellbore 100 illustrating an under-reamer 125 positioned at a predetermined location near the formation 115. As illustrated, the under-reamer 125 and a motor 130 are disposed at the lower end of coiled tubing 135. The under-reamer 125 is a mechanical downhole tool that is used to enlarge a wellbore 100 past its original drilled diameter. Typically, the under-reamer 125 includes blades that are biased closed during run-in for ease of insertion into the wellbore 110. The blades may subsequently be activated by fluid pressure to extend outward and into contact with the wellbore walls. Under-reamers by various manufacturers and types may be used with the present invention. One example of a suitable under-reamer is the Weatherford "Godzilla" under-reamer that includes blades disposed on a front portion and a rear portion.

In the preferred embodiment, the under-reamer 125 and motor 130 disposed on coil tubing 135 are run into the wellbore 100 to a predetermined location. While the under-reamer 125 is illustrated on coil tubing, it should be noted that under-reamer 125 may also be run into the wellbore 100 using a snubbing unit, jointed pipe using a conventional drilling rig, a hydraulic work over unit or any other device for lowering the under-reamer 125. The predetermined location is a calculated point near the formation 115. If more than one formation exists in the wellbore, each formation will be individually treated, starting with the formation closest to the surface of the wellbore. In this manner, a selected region within the wellbore 100 may be under-reamed without effecting other portions of the wellbore 100.

Figure 3:
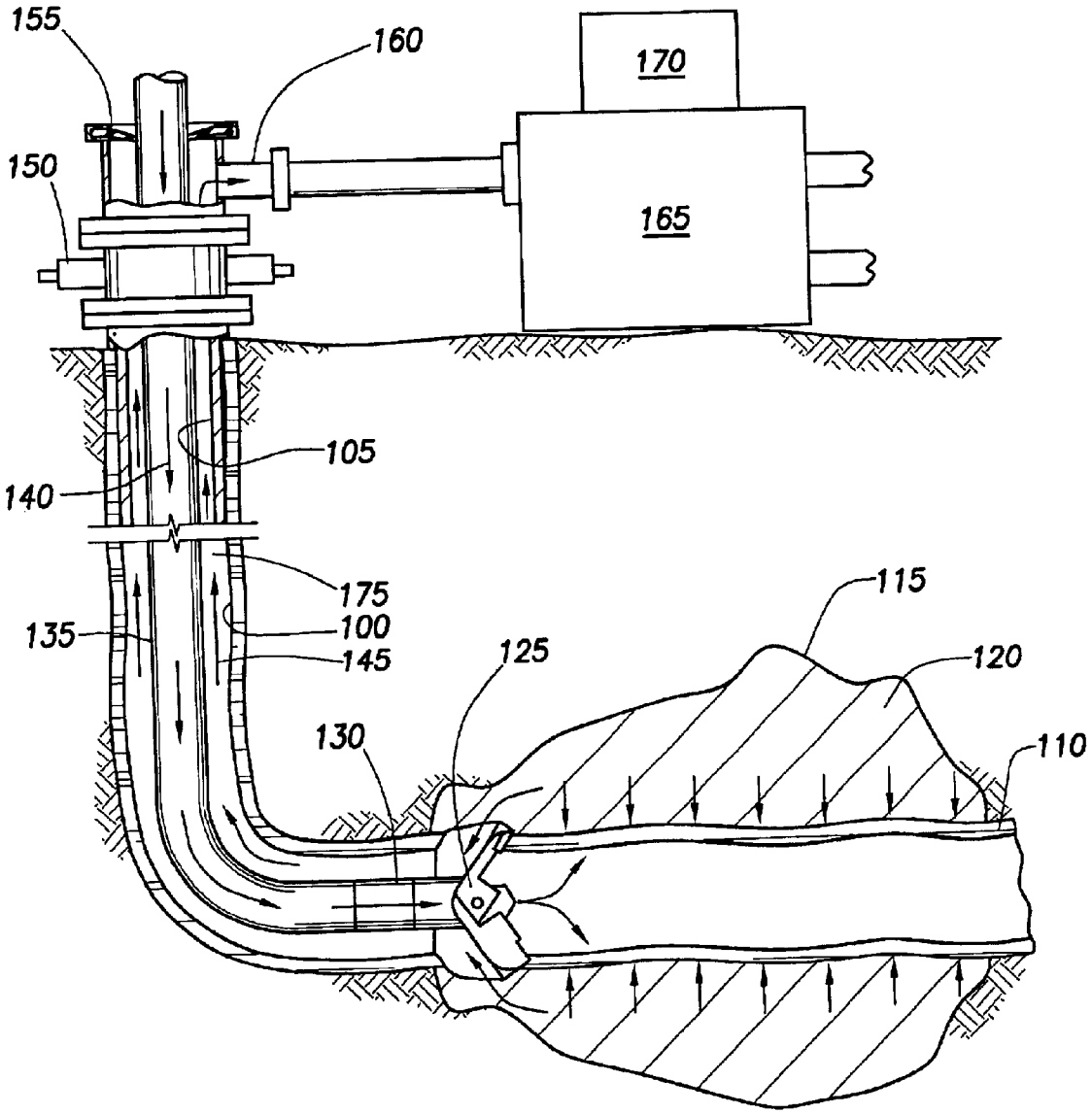
FIG. 3 illustrates an underbalanced under-reaming operation to remove the wellbore skin.

FIG. 3 illustrates an underbalanced, under-reaming operation to remove the wellbore skin 110. A typical preferred pressure condition, underbalanced under-reaming operation includes at least one blow out preventor 150 disposed at the surface of the wellbore 100 for use in an emergency and a control head 155 disposed around the coiled tubing 135 to act as a barrier between the drilling fluid and the rig floor. The system may further include a separation system 165 for separating the hydrocarbons that flow up an annulus 175 created between the coiled tubing 135 and the wellbore 100.

After the under-reamer 125 is located near the formation 115, the under-reamer 125 is activated, thereby extending the blades radially outward. A rotational force supplied by the motor 130 causes the under-reamer 125 to rotate. During rotation, the under-reamer 125 is urged away from the entrance of the wellbore 100 toward a downhole position for a predetermined length. As the under-reamer 125 travels down the wellbore, the blades on the front portion of the under-reamer 125 contact the diameter of the wellbore 100 and remove skin 110 formed on the diameter of the wellbore 100 and a small amount of the formation 115, thereby enlarging the diameter of the wellbore.

During the underbalanced under-reaming operation, drilling fluid, as illustrated by arrow 140, is pumped down the coiled tubing 135 and exits ports (not shown) in the under-reamer 125. The drilling fluid may be any type of relatively light drilling circulating medium, such as gas, liquid, foams or mist that effectively removes cuttings and fines created during the underbalanced, under-reaming operation. In the preferred embodiment, the drilling fluid is nitrogen gas and/or nitrified foam.

Typically, underbalanced bore operations are designed to produce a desired hydrostatic pressure in the well just below the formation pressures. In these instances, the drilling pressure is reduced to a point that will ensure a positive pressure gradient in the wellbore 100. In other words, in an underbalanced operation, the pressure in the formation 115 remains greater than the pressure in the wellbore 100. Generally, to reduce the hydrostatic pressure, the density of the drilling fluid is reduced by injecting an inert gas such as nitrogen or carbon dioxide into the wellbore. Incremental reduction in drilling pressures can be made with a small increase in the gas injection rates. In one aspect of the present invention, an underbalanced condition or preferred pressure condition between the hydrostatic pressure in the annulus 175 and the downhole reservoir pressure is achieved by regulating the amount and density of the drilling fluid that is pumped down the coiled tubing 135.

Underbalanced, under-reaming minimizes the formation of an additional skin layer on the wellbore diameter. During operation, the underbalanced condition allows the drilling fluid and the formation fluid 120 that enters the wellbore 100 to migrate up the annulus 175 as illustrated by arrow 145. The constant flow of fluid up the annulus 175 carries the drill cuttings and fines out of the wellbore 100. Thus, the cuttings and fines are prevented from entering the formation 115 and clogging the pores, thereby reducing the potential for a new skin layer.

Underbalanced under-reaming may also provide a controlled inflow of formation fluids 120 back into the wellbore 100, thereby under-reaming and producing a wellbore 100 at the same time. During operation, formation fluid 120 and drilling fluid migrate up the annulus 175 and exit port 160 into the separation system 165. The separation system 165 separates the formation fluid from the drilling fluid. The separated drilling fluid is recycled and pumped back down the coiled tubing 135 to the under-reamer 125 for use in the under-reaming operation.

In another embodiment, a data acquisition system 170 may be used in conjunction with the separation system 185. The data acquisition system 170 measures and records the amount of hydrocarbon production from the wellbore 100.

The system 170 collects data on the productivity of the specific well and compares the data with a theoretical value to determine the effectiveness of the under-reaming operation. The data acquisition system 170 may also be used in wells with several zones of interests to determine which zones are most productive and the effectiveness of the skin removal.

Figure 4:
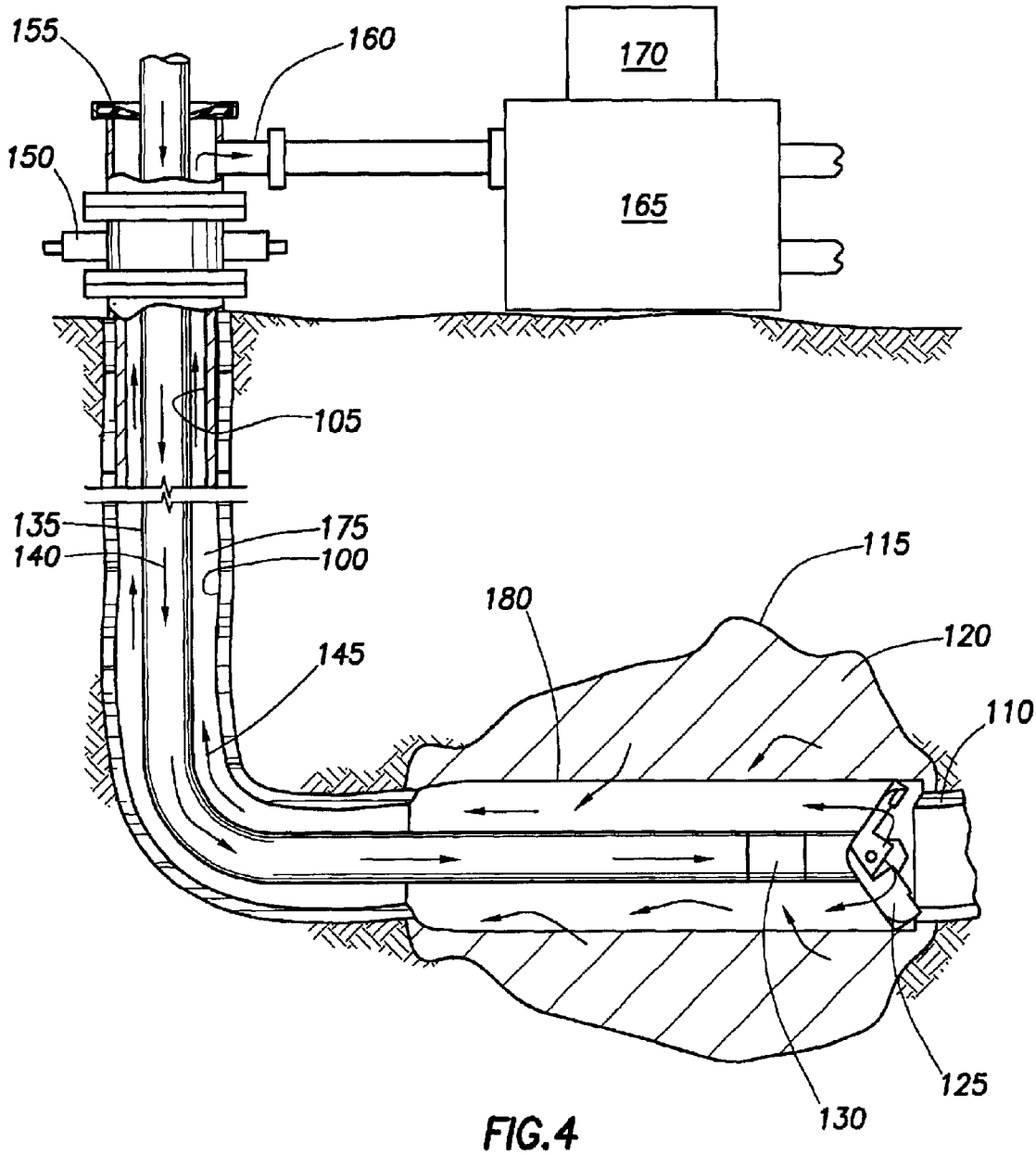
FIG. 4 illustrates an underbalanced back-reaming operation to ensure no additional skin damage is formed in wellbore.

FIG. 4 illustrates an underbalanced, back-reaming operation to ensure no additional skin damage is formed in wellbore 100. After the under-reamer 125 has removed the skin 110 and a portion of the formation 115, the process of back-reaming may be performed to remove any excess wellbore material, drill cuttings and fines remaining from the under-reaming operation. The blades on the rear portion of the under-reamer 125 are activated to contact the diameter of a newly under-reamed portion 180 of the wellbore 100. During rotation, the under-reamer 125 is urged from the downhole position toward the entrance of the wellbore 100. The movement of the under-reamer 125 toward the entrance of the wellbore allows the excess wellbore material, drill cuttings and fines to be immediately flushed up the annulus 175 and out of the wellbore 100.

During the back-reaming operation, drilling fluid, as indicated by arrow 140, is pumped down the coiled tubing 135, and exits ports (not shown) in the under-reamer 125. The drilling fluid is used to effectively remove excess wellbore material, drill cuttings and fines from the under-reamed portion 180. The density of the drilling fluid is monitored to ensure an underbalanced condition exists between the hydrostatic pressure in the annulus 175 and the reservoir pressure. Maintaining the hydrostatic pressure lower than the reservoir pressure prevents the drilling fluids from being forced into the formation 115 and may also provide a controlled inflow of formation fluids 120 into the wellbore 100. During operation, formation fluid 120 and drilling fluid migrate up the annulus 175 as illustrated by arrow 145 and exit port 160 into the separation system 165. The separation system 165 separates the formation fluid from the drilling fluid. The separated drilling fluid is recycled and pumped down the coiled tubing 135 to the under-reamer 125 for use in the back-reaming operation.

Figure 5:
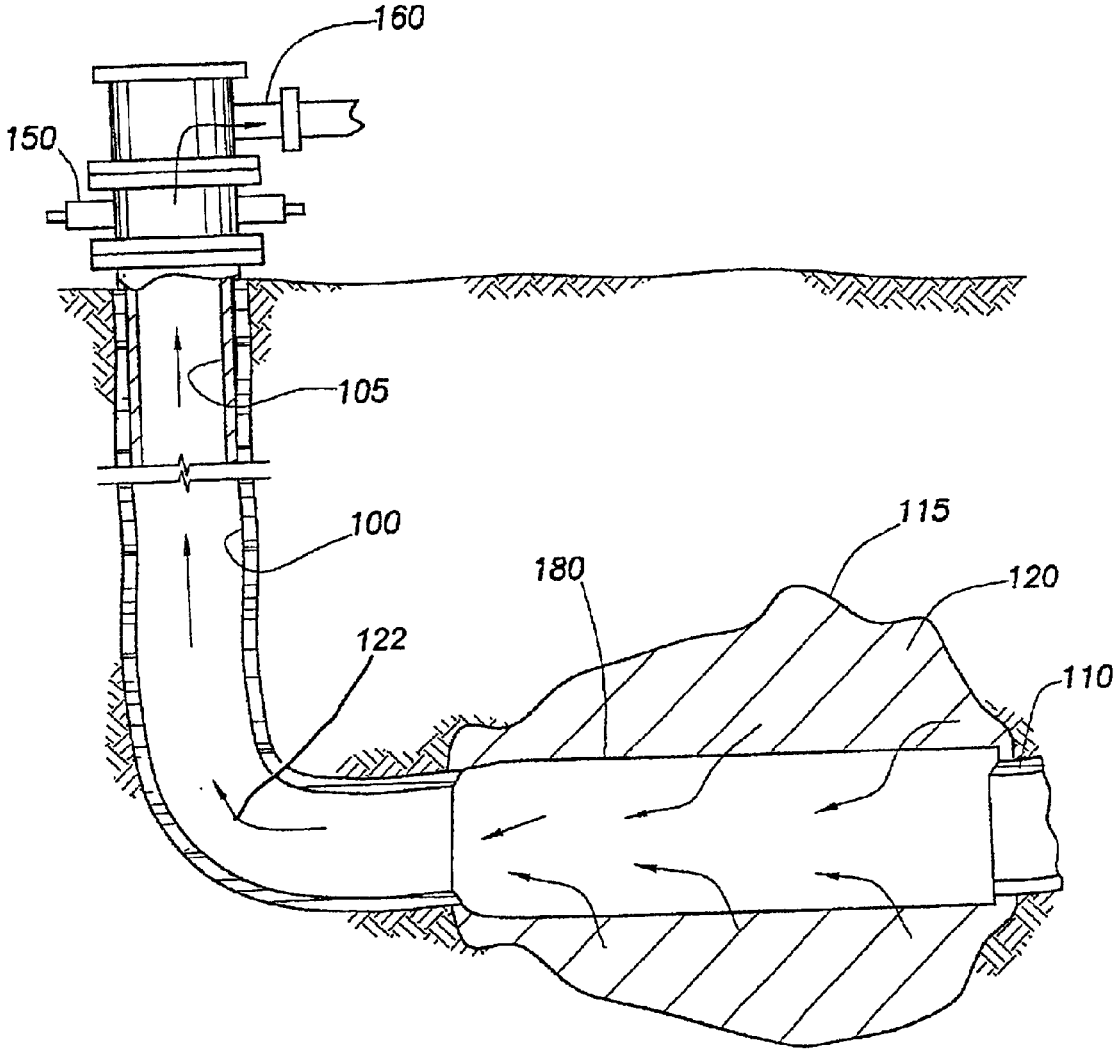
FIG. 5 is a cross-sectional view of a wellbore containing no skin damage in the under-reamed portion.

FIG. 5 is a cross-sectional view of a wellbore 100 containing no skin damage in the under-reamed portion 180. The under-reamed portion 180 has a larger diameter than the original diameter of wellbore 100 because all the skin 110 and a portion of the formation 115 have been removed, thereby resulting in a negative skin factor. The flow of formation fluid 120 is enhanced throughout the under-reamed portion 180. Consequently, the formation fluid 120 as illustrated by arrow 122 may freely migrate without restriction into the wellbore 100.

In another aspect, the under-reaming operation may be applied to a cased wellbore on order to remove a layer of wellbore skin which has been formed adjacent a perforated section of casing. To perform this operation a portion of casing near the zone of interest must be removed before starting the under-reaming operation. A procedure well known in the art called "section milling" may be used to remove the portion of casing near the zone of interest or reservoir. Section milling is described in U.S. Pat. No. 5,642,787 and U.S. Pat. No. 5,862,870, and both patents are incorporated herein by reference in their entirety. After the casing is removed, a skin layer similar to the skin layer as illustrated in FIG. 1 is exposed and ready for the under balanced under-reaming operation. The underbalanced under-reaming operation may follow in the manner described above.

While the foregoing is directed to embodiments of the present invention, other and further embodiments of the invention may be devised without departing from the basic scope thereof, and the scope thereof is determined by the claims that follow.

What is claimed is:

1. A method for increasing productivity of a well, comprising:

inserting an assembly into a wellbore, the assembly having:

an under-reamer disposed therewith;

positioning the under-reamer near a zone of interest in the well:

creating a preferred pressure condition in the wellbore; and increasing an inner diameter of the wellbore with the under-reamer, while maintaining the preferred pressure condition.

2. The method of claim 1, wherein the assembly further includes a tubular member disposable in the wellbore, wherein an annulus is formed between the tubular member and the wellbore.

3. The method of claim 2, further including pumping drilling fluid down the tubular member.

4. The method of claim 3, wherein the drilling fluid comprises nitrogen, foam or combinations thereof.

5. The method of claim 3, wherein maintaining the preferred pressure condition allows production fluid to migrate up the annulus and out of the wellbore.

6. The method of claim 5, wherein the preferred pressure condition is an under-balanced condition.

7. The method of claim 6, further including separating the production fluid into hydrocarbons and drilling fluid at a surface of the wellbore using a separating apparatus.

8. method of claim 7, wherein the separated drilling fluid is recycled and pumped down the tubular member.

9. The method of claim 8, further including measuring the amount of hydrocarbons exiting the wellbore by a data acquisition system to determine the productivity of the zone of interest and the effectiveness of increasing the diameter of the wellbore.

10. The method of claim 3, wherein creating the preferred pressure condition in the wellbore includes pumping drilling fluid down the tubular member to ensure a hydrostatic pressure in the annulus is below a pressure in the zone of interest.

11. The method of claim 1, wherein increasing the inner diameter includes removing a layer of skin by urging the under-reamer downhole to a predetermined point and thereafter allowing a first set of blades on the under-reamer to contact an Inner diameter of the wellbore.

12. The method of claim 11, wherein the diameter of a predetermined length of the wellbore is enlarged by the under-reamer.

13. The method of claim 12, further including performing a back-reaming operation on the predetermined length of the wellbore.

14. The method of claim 13, wherein the back-reaming operation allows a second set of blades on the under-reamer to contact the diameter of the wellbore.

15. The method of claim 1, further including activating the under-reamer by a hydraulic means.

16. The method of claim 1, further including deactivating the under-reamer and removing the assembly from the wellbore.

17. A method for increasing productivity of a well, comprising:

inserting an assembly into a wellbore, the assembly having:

a tubular member for transporting drilling fluid downhole, wherein an annulus is formed between the tubular member and the wellbore; and an under-reamer disposed proximate an end of the tubular member;

positioning the assembly near a zone of interest;

creating an under-balanced condition proximate the zone of interest pressure;

activating the under-reamer;

removing a layer of skin by urging the under-reamer along a predetermined length of the wellbore;

measuring the amount of hydrocarbons exiting the wellbore to determine the effectiveness of the skin removal;

maintaining the under-balanced condition; and deactivating the under-reamer and removing the assembly from the wellbore.

18. The method of claim 17, further including pumping drilling fluid down the tubular member, whereby the drilling fluid pumped down the tubular is used to maintain the hydrostatic pressure in the annulus below the zone of interest pressure.

19. The method of claim 18, wherein the drilling fluid comprises nitrogen, foam or combinations thereof.

20. The method of claim 18, further including separating the production fluid into hydrocarbons and drilling fluid at a surface of the wellbore by a separating apparatus, thereby allowing the drilling fluid to be pumped down the tubular member.

21. The method of claim 17, further including performing a back reaming operation on a pred termined length of the wellbore.

22. The method of claim 21, wherein the back-reaming operation allows the blades on a back portion of the under-reamer to contact the diameter of the wellbore.

23. The method of claim 17, further including measuring the amount of hydrocarbons exiting the wellbore by a data acquisition system to determine the productivity of the zone of interest.

24. A method for increasing productivity of a well, comprising:

inserting an assembly into a wellbore, the assembly including:

a tubular member for transporting drilling fluid downhole, wherein an annulus is formed between the tubular member arid the wellbore; and an under-reamer disposed proximate a lower end of the tubular member;

positioning the under-reamer near a zone of interest in the well;

pumping drilling fluid down the tubular member, whereby the drilling fluid pumped down the tubular is used to create a desired hydrostatic pressure proximate the zone of interest;

activating the under-reamer;

removing a layer of skin with the under-reamer for a predetermined length of the wellbore;

maintaining the desired hydrostatic pressure and allowing production fluid to migrate in to the wellbore;

measuring the amount of hydrocarbons exiting the wellbore to determine the productivity of the zone of interest; and deactivating the under-reamer and removing the assembly from the wellbore.

25. The method of claim 24, wherein the drilling fluid comprises nitrogen, foam or combinations thereof.

26. The method of claim 24, further including separating the production fluid into hydrocarbons and drilling fluid at a surface of the wellbore by a separating apparatus, thereby allowing the drilling fluid to be pumped down the tubular member.

27. The method of claim 24, further including performing a back-reaming operation on the predetermined length of the wellbore.

28. A method for increasing productivity of a well comprising:

forming a wellbore in an overbalanced condition;

inserting an assembly into the wellbore, the assembly having an under-reamer disposed therewith;

positioning the under-reamer near a zone of interest in the well;

creating a preferred pressure condition in the wellbore, the condition resulting in an underbalanced or near balanced wellbore; and increasing en inner diameter of the wellbore with the under-reamer, while maintaining the preferred pressure condition.

* * * * *

UNITED STATES PATENT AND TRADEMARK OFFICE

CERTIFICATE OF CORRECTION

PATENT NO. : 6,810,960 B2
DATED : November 2, 2004
INVENTOR(S) : Giancarlo T. Pia It is certified that error appears in the above-identified patent and that said Letters Patent is hereby corrected as shown below:

Column 6,
Line 35, please insert -- the -- before "method".
Line 51, please delete "Inner" and replace with -- inner --.

Column 7,
Line 33, please delete "pred termined" and replace with -- predetermined --.

Signed and Sealed this

Seventh Day of June, 2005

JON W. DUDAS
*Director of the United States Patent and Trademark Office*